US008752319B2

(12) United States Patent
Kunau

(10) Patent No.: US 8,752,319 B2
(45) **Date of Patent: *Jun. 17, 2014**

(54) GAP SEAL FOR GUN

(71) Applicant: Daniel Kunau, Boone, CO (US)

(72) Inventor: Daniel Kunau, Boone, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/093,612

(22) Filed: Dec. 2, 2013

(65) Prior Publication Data

US 2014/0082982 A1 Mar. 27, 2014

Related U.S. Application Data

(63) Continuation of application No. 13/155,743, filed on Jun. 8, 2011, now Pat. No. 8,621,772.

(51) Int. Cl.
*F41C 3/14* (2006.01)
*F41A 3/76* (2006.01)

(52) U.S. Cl.
CPC ..... *F41A 3/76* (2013.01)
USPC ..... 42/59

(58) Field of Classification Search
CPC ..... F41A 3/76
USPC ..... 42/59–68
See application file for complete search history.

(56) References Cited

U.S. PATENT DOCUMENTS

| | | | | | |
|---|---|---|---|---|---|
| 325,878 | A * | 9/1885 | Tyler | 42/59 |
| 2,938,458 | A * | 5/1960 | O'Brien | 102/430 |
| 2,981,023 | A * | 4/1961 | Sergay | 42/59 |
| 3,136,084 | A * | 6/1964 | Charron | 42/59 |
| 3,159,938 | A * | 12/1964 | Treat, Jr. et al. | 42/59 |
| 4,455,777 | A * | 6/1984 | Callies | 42/59 |
| 5,048,216 | A * | 9/1991 | Casull | 42/76.01 |
| 5,160,795 | A * | 11/1992 | Milliman | 42/65 |
| 5,333,531 | A * | 8/1994 | Field | 89/26 |
| 5,400,536 | A * | 3/1995 | Milliman | 42/65 |
| 6,658,780 | B2 * | 12/2003 | Papadimas | 42/59 |
| 8,459,166 | B2 * | 6/2013 | Herrmann et al. | 89/26 |

OTHER PUBLICATIONS

Notice of Allowance for U.S. Appl. No. 13/155,743, Sep. 3, 2013.

* cited by examiner

*Primary Examiner* — Samir Abdosh
(74) *Attorney, Agent, or Firm* — Brevetto Law Group

(57) ABSTRACT

A gun or other projectile launching device includes a frame, and a barrel, including a bore therethrough, held in position by the frame. A cylinder is rotatable attached to the frame in close proximity to an inner end portion of the barrel, the cylinder having multiple chambers and configured to sequentially and longitudinally align a chamber with the bore of the barrel. A sleeve is slidingly positioned over the inner end portion of the barrel. The sleeve has a front face with a central opening therethrough, that has a size less than an inner diameter of the sleeve, but no smaller than a diameter of the bore through the barrel. The sleeve is configured to slide back, substantially in response to gas pressure, until the front face of the sleeve is forcibly maintained in contact with the cylinder to eliminate a gap between the cylinder and the barrel.

20 Claims, 2 Drawing Sheets

GAP SEAL FOR GUN

CROSS-REFERENCE TO RELATED APPLICATIONS

This application is a continuation of U.S. patent application Ser. No. 13/155,743 entitled "REVOLVER CYLINDER GAP SEAL" filed on Jun. 8, 2011, the entire contents of which are hereby incorporated by reference.

FIELD OF THE INVENTION

This invention relates to guns which have a gap between the feed mechanism and the barrel. More particularly this invention relates to sealing the gap between the chamber of the feed mechanism that is aligned with the barrel, and the barrel, to enhance safety, as well as to contain energy loss and enhance bullet velocity.

BACKGROUND OF THE INVENTION

A revolver is the least expensive, shortest, lightest and most reliable multi-shot action gun available. Revolvers however do have their disadvantages. Most all of these disadvantages relate to the revolver gap, or the gap between the barrel and the revolving cylinder, or more particularly the gap between the barrel and the front of the chamber in the revolving cylinder which is aligned with the barrel. Unlike other firearms where the cartridges—each comprising a shell, filled with gun powder, and topped with a bullet, are individually and successively positioned within a firing chamber attached to the barrel; it has generally been accepted that the revolver gap is an inherent weakness in a revolver, necessitated by the need to provide clearance between the revolving cylinder and the barrel.

Probably the biggest disadvantage associated with the revolver gap is safety. People have been injured by lead pieces and burned by flame gases escaping through the gap. What is needed is a practical way to close the revolver gap. Not only would this increase gun safety, but additionally energy loss would be eliminated, thereby increasing bullet velocity and energy; combustion would be more complete in the chamber, resulting in less deviation and more shot accuracy; higher pressure cartridges could be used more effectively; benefits of longer gun barrels would be maximized; revolvers would be quieter for the shooter, moving sound away from the shooter's face; generally revolvers would be more cost effective; generally revolvers would be cheaper to manufacture, less precise tolerances being needed between the revolving cylinder and the barrel; and, revolver carbine rifles would become safer, more effective, and practical.

OBJECTS OF THE INVENTION

It is an object of this invention to disclose an effective and practical way of closing the revolver gap. It is an object of this invention to improve the safety and comfort of a revolver. It is an object of this invention to eliminate burns from high velocity lead pieces and powder flames. It is an object of this invention to make the operation of a revolver quieter by effectively moving sound away from the user's face. It is yet a further object of this invention to disclose a method to better completion of combustion, and increase efficiency, velocity and energy in a discharged bullet with a same sized bullet and shell. It is yet a further object of this invention to disclose a method better utilizing a longer barrel on a revolver. It is yet a further object of this invention to disclose a method making revolver carbines safer, more effective and practical. It is a final object of this invention to reduce manufacturing costs of revolvers by reducing the need for higher tolerances between the cylinder and the barrel, which are compensated for with the gap seal.

One aspect of this invention provides for the improvement in a revolver having a frame, carrying a barrel and a revolving cylinder having multiple cartridge chambers therearound, each configured to hold and sequentially and longitudinally align a cartridge therein carrying a bullet with a rear portion of the barrel, the improvement comprising: a sliding sleeve positioned over an inner end portion of the barrel, said end portion of the barrel and inner diameter of the sliding sleeve closely mated; said sliding sleeve having a front face having a central opening therethrough having an inner diameter nominally equivalent to marginally larger than, a bore through the barrel. Whereafter firing, the sliding sleeve is instantaneously driven back contacting its front face with the revolving cylinder, thereby eliminating any gap between the revolving cylinder and the barrel, preventing exploding gas from escaping therethrough, and substantially increasing bullet discharge velocity and energy.

In a preferred aspect of this invention a sliding sleeve as in claim 1 further comprising an enlargement in a back end portion of the bore of the barrel so that the central opening through the front face of the sliding sleeve, sized marginally larger than the bore, will thereby catch a periphery of a compressed airstream ahead of a fired bullet, as well as the hot combustion gases after the bullet passes therethrough.

In yet another preferred aspect of this invention the sliding sleeve further comprises a ring seal positioned between the sliding sleeve and one of the inner end portion of the barrel and the gun frame.

Various other objects, advantages and features of this invention will become apparent to those skilled in the art from the following description in conjunction with the accompanying drawings.

FIGURES OF THE INVENTION

Figure 1:
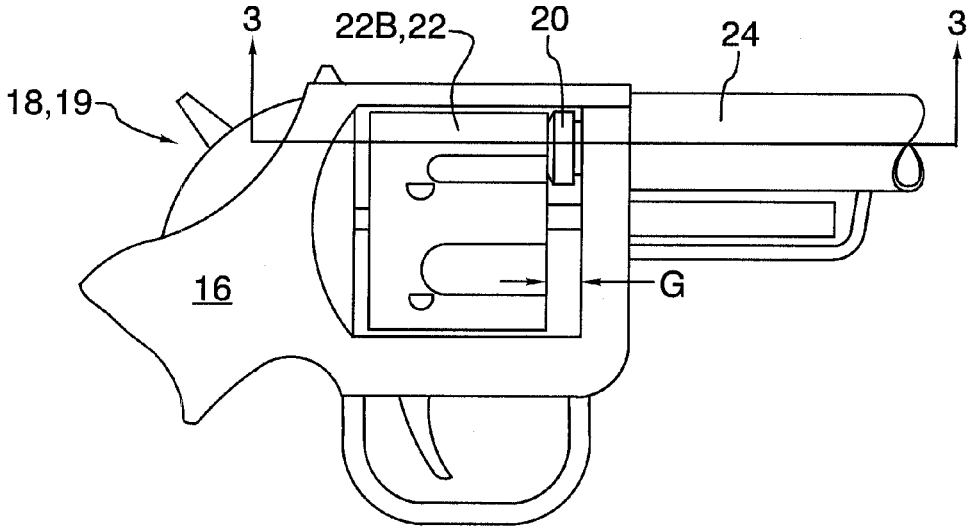
FIG. 1 is a perspective view of a revolver having a gap seal positioned over a diametrically reduced rear portion of the barrel in front of the revolver cylinder.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 2:
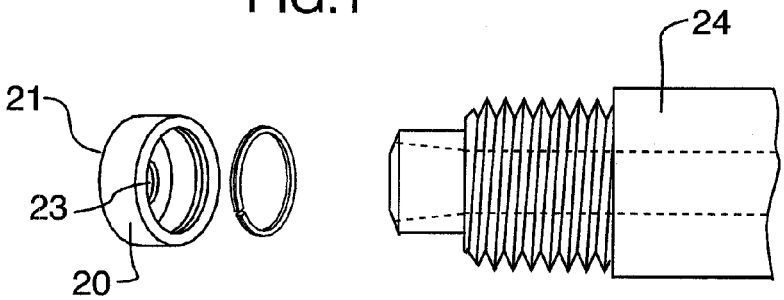
FIG. 2 is a perspective exploded view of a rear portion of the barrel and the gap seal shown in FIG. 1.

Turning now to the drawings, and more particularly to FIG. 1, we have a perspective view of a a revolver 18 having a gap seal positioned over a diametrically reduced rear portion of the barrel 24 in front of the revolving cylinder 22. FIG. 2 is a perspective exploded view of a rear portion of the barrel and the gap seal shown in FIG. 1. In a revolver having a frame 16, carrying a barrel 24 and a revolving cylinder 22 having multiple cartridge chambers 14 therearound, each configured to hold and sequentially and longitudinally align a cartridge 12 therein carrying a bullet 10, and shell 8, with a rear portion of the barrel 24, the improvement most broadly comprises: a) a sliding sleeve 20 positioned over an inner end portion of the barrel 24, said end portion of the barrel 24 and inner diameter of the sliding sleeve 20 closely mated; and, b) said sliding sleeve 20 having a front face 21 having a central opening 23 therethrough having an inner diameter nominally equivalent to marginally larger than, a bore B through the barrel 24. Whereafter firing, the sliding sleeve 20 is instantaneously driven back contacting its front face 21 with the revolving cylinder 22, thereby eliminating any gap G between the revolving cylinder 20 and the barrel 24, preventing exploding gas from escaping through the gap G, and substantially increasing bullet 10 discharge velocity and energy.

Figure 3:
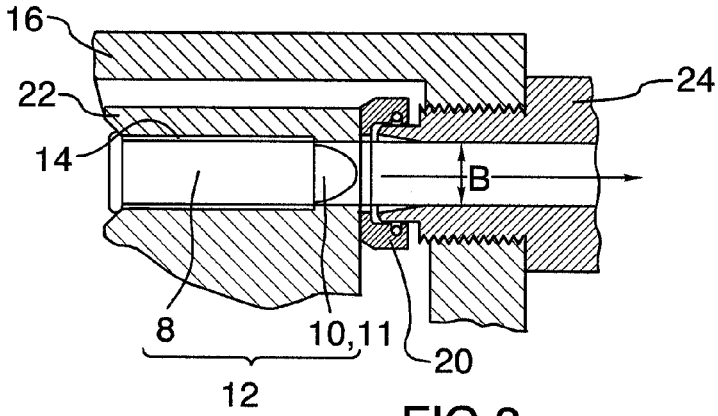
FIG. 3 is a partial cross sectional view of the gun frame, the revolver cylinder the gap seal and a rear portion of the barrel as taken along line 3-3 in FIG. 1.
Figure 4:
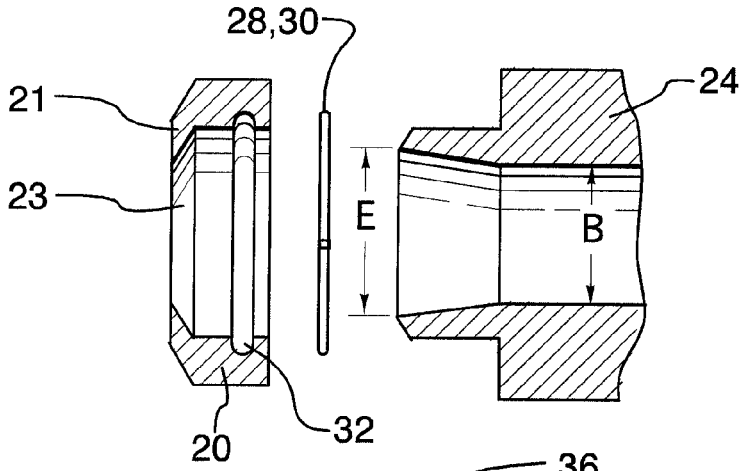
FIG. 4 is an enlarged cross sectional exploded view of a rear portion of the barrel and the gap seal shown in FIG. 1.

FIG. 3 is a partial cross sectional view of the gun frame, the revolver cylinder the gap seal and a rear portion of the barrel as taken along line 3-3 in FIG. 1. FIG. 4 is an enlarged cross sectional exploded view of a rear portion of the barrel and the gap seal shown in FIG. 1. If the sliding sleeve 20 is used in conjunction with an enlarged diameter E in a back end portion of the bore B of the barrel 24 then the central opening 23 through the front face 21 of the sliding sleeve 20, sized marginally larger than the bore B, will thereby catch a periphery of a compressed airstream ahead of a fired bullet 10, as well as the hot combustion gases after the bullet 10 passes therethrough. Most preferably, the sliding sleeve 20 further comprises a ring seal 28 positioned between the sliding sleeve 20 and one of the inner end portion of the barrel 24 and the gun frame 16. In the most preferred embodiment of the invention the ring seal 28 comprises a split ring 30.

Figure 5:
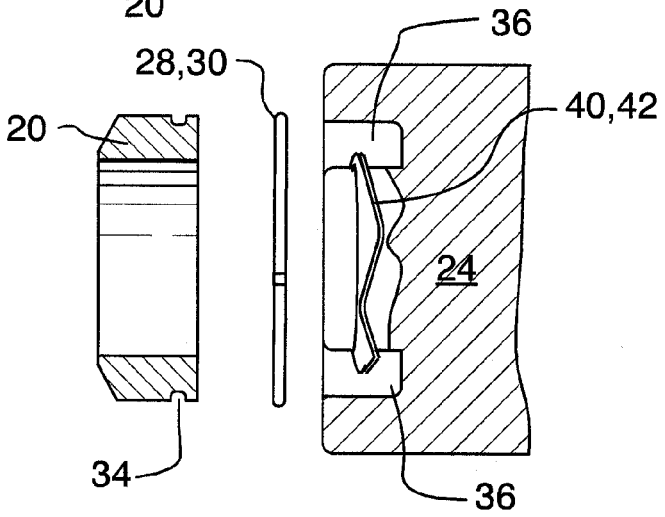
FIG. 5 is an enlarged cross sectional exploded view of a rear portion of the barrel and a gap seal, this variation preferred for large bore revolvers including shot gun revolvers which generally are not presently practical due to problems with the revolver gap.
Figure 6:
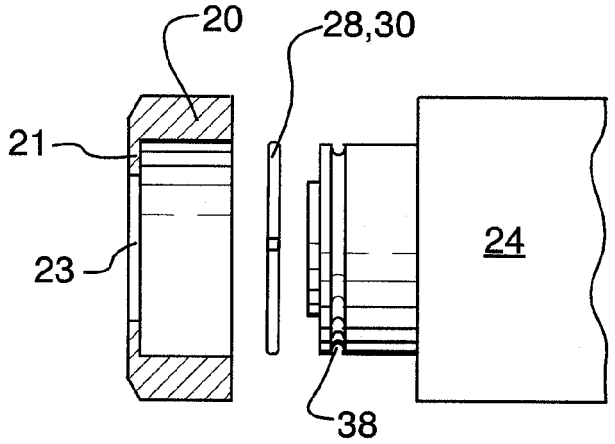
FIG. 6 is an enlarged cross sectional exploded view of yet another variation of the invention, preferred for smaller bore revolvers.

Again referring to FIG. 4, an enlarged cross sectional exploded view of a rear portion of the barrel and the gap seal shown in FIG. 1, we have an embodiment of the invention, preferred for revolvers 18 of the bore B most commonly used. Herein the ring seal 28 is positioned within an interior peripheral groove 32 within the sliding sleeve 20, and slides over and along the inner end portion of the barrel 24. FIG. 5 is an enlarged cross sectional exploded view of a rear portion of the barrel and a gap seal, this variation preferred for large bore revolvers 18 including shot gun revolvers 18 which generally are not presently practical due to problems with the revolver gap G. It is noted that with the sliding sleeve 20 sealing the revolver gap G it is possible to use the revolver 18 format for a shot gun. Mostly for safety reasons, it was not previously practical to have a revolver 18 shot gun. This embodiment of the invention is generally preferred for revolvers 18 of larger bore B. Herein, the ring seal 28 is positioned within an exterior peripheral groove 34 around the sliding sleeve 20, and the periphery of the ring seal 20 slides within and along a recessed circular groove 36 around the inner end portion of the barrel 24. It is noted that the recessed circular groove 36 may be either within an end portion of the barrel 24, or within the frame 16 therearound, or partially within the frame 16 and the end portion of the barrel 24. FIG. 6 is an enlarged cross sectional exploded view of yet another variation preferred for smaller bore revolvers 18. Herein, the ring seal 28 is positioned within an exterior peripheral groove 38 around the inner end portion of the barrel 24, and the periphery of the ring seal 28 slides along and within the inner diameter of the sliding sleeve 20.

In yet another preferred embodiment of the invention, a bias means 40 is positioned over and around the back end portion of the barrel 24 to urge the front face of the sliding sleeve 20 against the revolving cylinder 22 prior to firing. In the most preferred embodiment of the invention the bias means comprises a spring washer 42.

It is noted that use of a sliding sleeve 20 has broader application. In a projectile launching device 19—such as a paint ball marker, air gun, or a riot control gun launching projectiles (including tear gas balls, pepper gas balls, bean bags, and rubber bullets)—having a frame 16, carrying a barrel 24 and a projectile feed mechanism 22B, configured to hold and sequentially align a projectile 11 therein with a rear portion of the barrel 24, the improvement comprising: a) a sliding sleeve 20 positioned over an inner end portion of the barrel 24, said end portion of the barrel 24 and inner diameter of the sliding sleeve 20 closely mated; and, b) said sliding sleeve 20 having a front face 21 having a central opening 23 therethrough having an inner diameter nominally equivalent to marginally larger than, a bore B through the barrel 24. Whereafter firing, the sliding sleeve 20 is instantaneously driven back contacting its front face 21 with the feed mechanism 22B, thereby eliminating any gap G between the feed mechanism 22B and the barrel 24, preventing exploding gas from escaping therethrough, and substantially increasing projectile 11 discharge velocity and energy.

While the invention has been described with preferred specific embodiments thereof, it will be understood that this description is intended to illustrate and not to limit the scope of the invention, which is defined by the following claims.

I claim:

1. In a projectile launching device having a frame carrying a barrel and a projectile feed mechanism configured to hold and sequentially align a projectile therein with a rear portion of the barrel, the improvement comprising:

a) a sliding sleeve positioned over an inner end portion of the barrel, said inner end portion of the barrel and an inner diameter of the sliding sleeve closely mated; and, b) said sliding sleeve having a front face having a central opening therethrough having an inner diameter nominally equivalent to marginally larger than, a bore through the barrel;

whereafter firing, the sliding sleeve is instantaneously driven back, substantially by gas pressure, until the front face of the sliding sleeve makes contact with the feed mechanism, thereby eliminating any gap between the feed mechanism and the barrel, preventing gas from escaping therethrough, and substantially increasing projectile discharge velocity and energy, and subsequently, after the projectile is fully discharged, and gas pressure drops, said sliding sleeve is no longer forcibly maintained in a gap eliminating position.

2. In the projectile launching device, said sliding sleeve as in claim 1, further comprising a ring seal positioned between the sliding sleeve and the inner end portion of the barrel or a frame of the projectile launching device.

3. A gun comprising:

a frame;

a barrel, including a bore therethrough, and held in position by the frame;

a cylinder rotatably attached to the frame in close proximity to an inner end portion of the barrel, the cylinder having multiple chambers and configured to sequentially and longitudinally align a chamber with the bore of the barrel; and a sleeve slidingly positioned over the inner end portion of the barrel, the sleeve having a front face with a central opening therethrough, the central opening having a diameter less than an inner diameter of the sleeve, but no smaller than a diameter of the bore through the barrel;

wherein the sleeve is configured to slide back, substantially in response to gas pressure, until the front face of the sleeve is forcibly maintained in contact with the cylinder to eliminate a gap between the cylinder and the barrel.

4. The gun of claim 3, wherein in response to reduced gas pressure, the sleeve is configured to no longer be forcibly maintained in contact with the cylinder.

5. The gun of claim 3, further comprising:

an enlargement in a back end portion of the bore of the barrel;

wherein a rear size of the enlargement is larger than the central opening through the front face of the sleeve.

6. The gun of claim 3, wherein the gas pressure is generated by one or more of a compressed airstream ahead of a projectile moving from the chamber into the barrel or expanding gas propelling the projectile through the bore of the barrel.

7. The gun of claim 3, wherein the inner diameter of the sleeve is closely mated to the inner end portion of the barrel.

8. The gun of claim 3, further comprising:

a ring seal positioned between the sleeve and the frame or the inner end portion of the barrel.

9. The gun of claim 8, wherein the ring seal comprises a split ring.

10. The gun of claim 3, further comprising:

a ring seal positioned within an interior peripheral groove within the sleeve;

wherein the ring seal is configured to closely mate to and slide over the inner end portion of the barrel.

11. The gun of claim 3, further comprising:

a ring seal positioned within an exterior peripheral groove around the sleeve;

wherein the ring seal is configured to closely mate to and slide within a recessed circular groove around the inner end portion of the barrel.

12. The gun of claim 3, further comprising:

a ring seal positioned within an exterior peripheral groove around the inner end portion of the barrel;

wherein the ring seal is configured to closely mate to the inside diameter of the sleeve; and wherein the sleeve is configured to slide over the ring seal.

13. The gun of claim 3, the sleeve further comprising:

a chamfered outer edge on an end of the sleeve adjacent to the cylinder.

14. A method to close a gap between a feed mechanism and a barrel of a projectile launching device, the method comprising:

providing little to no force to hold a sleeve in contact with the feed mechanism before firing a projectile from the projectile launching device;

firing the projectile from a chamber of the feed mechanism through the barrel;

sliding a sleeve back from the barrel, substantially using gas pressure created by the firing of the projectile, until a front face of the sleeve makes contact with the feed mechanism to close the gap between the feed mechanism and the barrel; and preventing gas from escaping through the gap between the feed mechanism and the barrel.

15. The method of claim 14, further comprising:

releasing the gas pressure on the sleeve that forcibly maintained the sleeve in a position to close the gap between the feed mechanism and the barrel so that little to no force to hold the sleeve in contact with the feed mechanism is provided after the projectile has left the barrel.

16. The method of claim 14, further comprising:

applying the backward force from the gas pressure on an inside surface of the front face of the sleeve;

wherein the inside surface of the front face of the sleeve is created by a central opening through the front face having a diameter less than an inner diameter of the sleeve but no smaller than about a diameter of a bore through the barrel.

17. The method of claim 14, further comprising:

inserting a shell into a chamber of the feed mechanism, the shell comprising gun powder and a bullet; and igniting the gun powder to fire the bullet;

wherein the projectile comprises the bullet.

18. The method of claim 17, wherein the gas pressure is created by one or more of by a compressed airstream ahead of the bullet moving from the chamber into the barrel or exploding gas from the ignited gun powder.

19. The method of claim 14, wherein the firing comprises:

releasing compressed gas into the chamber of the feed mechanism behind the projectile;

wherein the projectile is a paint ball, a tear gas ball, a pepper gas ball, a bean bag, or a rubber bullet.

20. The method of claim 14, further comprising:

rotating the feed mechanism from a first position to a second position, wherein the feed mechanism comprises a rotating cylinder;

wherein the first position of the feed mechanism aligns the chamber of the feed mechanism with the barrel, and the second position of the feed mechanism aligns another chamber containing another projectile with the barrel.

* * * * *